US009146484B2

(12) United States Patent
Ota et al.

(10) Patent No.: US 9,146,484 B2
(45) Date of Patent: Sep. 29, 2015

(54) TONERS FOR ELECTROSTATIC-IMAGE DEVELOPMENT

(71) Applicant: MITSUBISHI CHEMICAL CORPORATION, Chiyoda-ku (JP)

(72) Inventors: Masaya Ota, Yokohama (JP); Tomohiko Tokunaga, Yokkaichi (JP); Kazuo Mitsuhashi, Joetsu (JP)

(73) Assignee: Mitsubishi Chemical Corporation, Chiyoda-ku (JP)

( * ) Notice: Subject to any disclaimer, the term of this patent is extended or adjusted under 35 U.S.C. 154(b) by 0 days.

(21) Appl. No.: 14/507,870

(22) Filed: Oct. 7, 2014

(65) Prior Publication Data

US 2015/0024324 A1 Jan. 22, 2015

Related U.S. Application Data

(62) Division of application No. 11/718,151, filed as application No. PCT/JP2005/019904 on Oct. 28, 2005, now abandoned.

(30) Foreign Application Priority Data

Oct. 29, 2004 (JP) ..... 2004-316450

(51) Int. Cl.
*G03G 9/087* (2006.01)
*G03G 9/08* (2006.01)

(52) U.S. Cl.
CPC ..... *G03G 9/0802* (2013.01); *G03G 9/0804* (2013.01); *G03G 9/0806* (2013.01); *G03G 9/0819* (2013.01); *G03G 9/0821* (2013.01); *G03G 9/0827* (2013.01); *G03G 9/08711* (2013.01); *G03G 9/08733* (2013.01); *G03G 9/08793* (2013.01); *G03G 9/08795* (2013.01); *G03G 9/08797* (2013.01)

(58) Field of Classification Search
CPC . G03G 9/0802; G03G 9/0804; G03G 9/0806; G03G 9/08711
See application file for complete search history.

(56) References Cited

U.S. PATENT DOCUMENTS

| | | | | |
|---|---|---|---|---|
| 4,971,879 | A | 11/1990 | Kimura et al. | |
| 5,126,224 | A | 6/1992 | Hyosu et al. | |
| 5,204,413 | A | 4/1993 | Funato et al. | |
| 5,333,059 | A | 7/1994 | Hyosu et al. | |
| 5,354,640 | A | 10/1994 | Kanbayashi et al. | |
| 5,407,776 | A | 4/1995 | Kanbayashi et al. | |
| 5,447,813 | A * | 9/1995 | Hagiwara et al. | 430/109.3 |
| 5,807,654 | A | 9/1998 | Kubo et al. | |
| 6,103,438 | A | 8/2000 | Kubo et al. | |
| 6,447,971 | B2 * | 9/2002 | Takezawa et al. | 430/110.2 |
| 6,495,648 | B1 | 12/2002 | Inagaki et al. | |
| 2003/0152857 | A1 | 8/2003 | Sugiura et al. | |
| 2003/0219666 | A1 | 11/2003 | Kitani et al. | |
| 2004/0137347 | A1 * | 7/2004 | Yamazaki et al. | 430/100 |

FOREIGN PATENT DOCUMENTS

| | | | |
|---|---|---|---|
| CN | 1459672 | | 12/2003 |
| DE | 695 33 186 | T2 | 7/2005 |
| EP | 0 720 064 | A1 | 7/1996 |
| EP | 1 026 551 | A1 | 8/2000 |
| JP | 64-70765 | | 3/1989 |
| JP | 1-238671 | | 9/1989 |
| JP | 1-284863 | | 11/1989 |
| JP | 3-101746 | | 4/1991 |
| JP | 5-197193 | | 8/1993 |
| JP | 8-30025 | | 2/1996 |
| JP | 8-253562 | | 10/1996 |
| JP | 2000-172010 | | 6/2000 |
| JP | 2001-296693 | | 10/2001 |
| JP | 2001-305797 | | 11/2001 |
| JP | 2002-72547 | | 3/2002 |
| JP | 2003-57867 | | 2/2003 |
| JP | 2003-84502 | | 3/2003 |
| JP | 2003-91093 | | 3/2003 |
| JP | 2003-342363 | | 12/2003 |
| JP | 2004-46131 | | 2/2004 |
| JP | 2004-54256 | | 2/2004 |
| KR | 100236511 | B | 1/2000 |
| TW | 541319 | | 7/2003 |
| WO | 96/02870 | | 2/1996 |
| WO | 99/23533 | | 5/1999 |

* cited by examiner

*Primary Examiner* — Peter Vajda
(74) *Attorney, Agent, or Firm* — Oblon, McClelland, Maier & Neustadt, L.L.P.

(57) ABSTRACT

To provide an emulsion polymerized agglomerated toner for electrostatic charge image which is excellent in the fixing property even at a high temperature without deteriorating other properties and which does not emit an odor offensive to people, and a process for its production.
An emulsion polymerized agglomerated toner characterized in that the odor index of aliphatic aldehydes measured by gas chromatography is at most 300, and an emulsion polymerized agglomerated toner which is an emulsion polymerized agglomerated toner obtainable via a polymerization step, a flocculation step and an aging step, characterized in that an emulsion polymerized latex before the flocculation step is a latex having a peroxide value of at most 30.

11 Claims, No Drawings

TONERS FOR ELECTROSTATIC-IMAGE DEVELOPMENT

This application is a divisional of U.S. application Ser. No. 11/718,151 filed Aug. 3, 2007, which is a National Stage of PCT/JP2005/019904 filed Oct. 28, 2005, both of which are incorporated herein by reference. This application also claims the benefit of JP 2004-316450 filed Oct. 29, 2004.

TECHNICAL FIELD

The present invention relates to an emulsion polymerized agglomerated toner to be used for copying machines and printers of an electrophotographic system. More particularly, it relates to an emulsion polymerized agglomerated toner having its odor improved.

BACKGROUND ART

An electrophotographic technique is used not only in the field of copying machines but also widely in the field of various printers in recent years from the viewpoint of immediacy, high quality of images, etc. Formation of a visible image by an electrophotographic system is carried out usually by firstly forming an electrostatic latent image on a photoreceptor such as a drum or a belt, then developing it with a toner, then transferring it to a transfer medium such as a transfer paper, and then fixing the toner to the transfer medium by e.g. heating by a fixing roller.

Various performances are required for copying machines, printers or the like, but a problem of an odor emitted from such development devices has become serious more than ever in the present office environment in which a plurality of development devices are always in operation. As one of factors for the odor emitted from a development device, an odor attributable to a toner may be mentioned, and it is considered that the odor is emitted particularly during the above-mentioned heating for fixing.

To reduce the odor of the toner, various studies have been made. For example, there have been a method wherein low volatile components are degassed during the kneading at the time of producing a toner by a melt-kneading pulverization method, and a method wherein attention is paid to the residual monomer, the remaining solvent or benzaldehyde, and the weight fraction thereof in the toner is reduced (Patent Document 1). Further, in a suspension polymerization method or an emulsion polymerization flocculation method, wherein toner particles are granulated in water, it is known to adopt a method wherein the residual monomer is reduced by increasing the monomer addition rate during the polymerization, or deaeration is carried out during the drying. For example, in the case of producing a toner by a suspension polymerization method, (1) a method of accelerating the consumption of the polymerizable monomer at the time when the conversion for polymerization has reached at least 95%, and (2) a method of removing the organic solvent, the polymerizable monomer or their mixture from the toner particles, are known (Patent Document 2).

Patent Document 1: JP-A-3-101746

Patent Document 2: JP-A-5-197193

On the other hand, along with the trend for high speed of copying machines in recent years, it has been attempted to raise the temperature at the fixing portion to carry out the fixing at a high speed. Usually, if fixing is carried out at a high temperature, a phenomenon (high temperature offset) is likely to result wherein the toner will attach to the fixing component. To prevent such high temperature offset, it is common to employ a technique wherein the molecular weight of a resin constituting the main component of the toner is increased (Patent Document 3). As a method to increase a high molecular weight component, a method for polymerization at a low temperature is, for example, known.

Patent Document 3: JP-A-63-115435

DISCLOSURE OF THE INVENTION

Problems to be Solved by the Invention

However, with respect to an odor which is offensive to people, improvement in its reduction has not yet reached a satisfactory level, although an odor as a total amount has been certainly reduced by any one of the above-mentioned methods. Further, when the fixing property at a high temperature is required, if, for example, the above-mentioned method for polymerization at a low temperature is adopted, the polymerization rate tends to be slow, and the amount of the remaining monomer tends to increase accordingly, whereby such a monomer has been a cause of an odor, which deteriorates the office environment.

Namely, it has not been known how to obtain an emulsion polymerized agglomerated toner for electrostatic charge image which is excellent in the fixing property at a high temperature and which does not emit an odor offensive to people.

For example, in a case where the above-mentioned method (1) of a suspension polymerization method is employed as a method for producing an emulsion polymerized agglomerated toner, if polymerization is carried out under a high temperature condition in order to increase the conversion for polymerization, it is difficult to obtain a high molecular weight component, and a high temperature offset is likely to result, whereby it has been impossible to remove the odor component other than one derived from the monomer. Further, in a case where the above method (2) is to be employed, the particle size of the finally obtainable toner tends to be large at a level of from about 6 to 10 μm, whereby there has been a limit in removal of the odor component present in the interior of toner particles, even if the odor component is reduced by deaeration.

The present invention has been made in view of the prior art, and it is an object of the present invention to provide an emulsion polymerized agglomerated toner which is excellent in the fixing property even at a high temperature without deteriorating other properties and which does not emit an odor offensive to people.

Means to Solve the Problems

1. As a result of an extensive study to solve the above problems, the present inventors have found that no odor will be sensed by people for the first time by reducing the odor index as the sum of values obtained by dividing the concentrations of specific volatile components having low odor threshold values contained in the toner by their threshold values, and by incorporating a crosslinked component in the toner. On the basis of such a discovery, it has been found possible to solve the above problems, and the present invention has been accomplished. Namely, the gist of the present invention resides in an emulsion polymerized agglomerated toner characterized in that an odor index as calculated from the contents of aliphatic aldehydes in the toner measured by gas chromatography and the odor threshold values of the aliphatic aldehydes, is at most 300, and it contains a cross-linked component.

Effects of the Invention

According to the present invention, it is possible to provide an emulsion polymerized agglomerated toner for electrostatic charge image, which is excellent in the fixing property even at a high temperature without deteriorating other properties and which does not emit an odor offensive to people, and a process whereby such a toner can be efficiently produced.

BEST MODE FOR CARRYING OUT THE INVENTION

Now, the present invention will be described in detail, but it should be understood that the present invention is by no means restricted to the following embodiments and may be optionally modified within a range not to depart from the concept of the present invention.

The present inventors have found that the odor can be suppressed only when the substances with an odor offensive to people are effectively reduced. Namely, even with the same amounts, there are a substance with an odor smelled by people and a substance with no such an odor, and unless a substance with an odor offensive to people even in a low amount i.e. a substance with an odor highly smelled rather than a substance with an odor less smelled, is reduced, it is not possible to substantially reduce the odor. Accordingly, in order to reduce the odor, it is totally inadequate to simply reduce the concentration of odor substances, and it is necessary to take into consideration the odor threshold value as an index of an odor sensed by people.

Among them, aliphatic aldehydes will emit offensive odors. According to a literature, for example, the threshold value of benzaldehyde is 42 ppb, while the threshold value of 1-octanal is 0.01 ppb, i.e. the difference is as much as 4,200 times. Namely, even in the same category of aldehydes, rather than reducing benzaldehyde, reducing 1-octanal is effective 4,200 times as the sensitivity of people to odors.

For example, when benzaldehyde contained in a conventional toner is measured by gas chromatography, it is usually present in an amount of 3.5 ng/ml, and 1-octanal measured in the same manner is present in an amount of 3.9 ng/ml. When odor indices are calculated from the contents of these volatile components, the odor index of benzaldehyde is at least 0.08, and the odor index of 1-octanal is at least 386. Namely, it is more effective to remove 1-octanal which emits an odor 4,825 times as compared with benzaldehyde. Other aliphatic aldehydes contained in a toner have odor indices higher than benzaldehyde.

The toner of the present invention is characterized in that the odor index calculated from the contents of aliphatic aldehydes in the toner measured by gas chromatography and the odor threshold values of such aliphatic aldehydes, is at most a specified value.

Odor Threshold Values

An odor threshold value is meant for a concentration of a volatile substance at which people start to sense the odor. It is necessary to take into consideration an odor threshold value of an aliphatic substance having a low odor threshold value, particularly that of an aliphatic aldehyde. Such concentrations of volatile substances at which people start to sense the odor, are defined in "Results of Measurement of Threshold Values of Odor Substances by Three Point Comparative Odor Bag Method" (Yoshio Nagai, Norifumi Takeuchi, Japan Environmental Sanitation Center, 1990, No. 17, p. 77) and "Compilation of Odor and Taste Threshold Values Data" (F. A. Fazzalari, ASTM DATA Series DS 48A, 1991), and as the odor threshold values for the present invention, such values or values determined in accordance with the method disclosed in such literatures, are employed.

Aliphatic Aldehydes

The aliphatic aldehydes, of which the values stipulated in the present invention are to be minimized, are compounds having a hydrogen atom or an aliphatic hydrocarbon substituted by an aldehyde group and ones having from 1 to 4 aldehyde groups and from 1 to 10 carbon atoms, per molecule. Further, such aliphatic aldehydes may be saturated or unsaturated, but they are particularly preferably saturated ones. Further, they may be of a straight chain structure or a cyclic structure, but they are particularly preferably ones having straight chain structures.

Among them, in order to reduce the odor of a toner, the following aliphatic aldehydes having odor threshold values may be mentioned, i.e. six types of 1-butanal (threshold value: 0.67 ppb), 1-pentanal (threshold value: 0.41 ppb), 1-hexanal (threshold value: 0.28 ppb), 1-haptanal (threshold value: 0.18 ppb), 1-octanal (threshold value: 0.01 ppb) and 1-nonanal (threshold value: 0.34 ppb).

Aliphatic Acids

Further, in the present invention, it is preferred to reduce also the odor attributable to aliphatic acids. Such an aliphatic acid is a compound having a hydrogen atom or an aliphatic hydrocarbon substituted by a carboxyl group and is one having from 1 to 4 carboxyl group and from 1 to 9 carbon atoms, per molecule. Further, such aliphatic acids may be saturated or unsaturated, but they are particularly preferably saturated ones. Further, they may be of a straight chain structure or a cyclic structure, but they are particularly preferably ones having straight chain structures.

Among them, in order to reduce the odor of the toner, the following aliphatic acids having low odor threshold values may be mentioned, i.e. four types of butyric acid (threshold value: 0.19 ppb), n-pentanoic acid (threshold value: 0.037 ppb), n-hexanoic acid (threshold value: 0.6 ppb) and n-heptanoic acid (threshold value: 0.21 ppb). It is necessary to pay particular attention to reduction of n-pentanoic acid having a low threshold value (threshold value: 0.037 ppb).

Gas Chromatography Method

The odor index in the present invention is obtained by the following measuring method. Namely, in the preparation of a test sample, an emulsion polymerized agglomerated toner is developed on a paper (FC dream paper, manufactured by Kishu Paper Co., Ltd.) so that its weight will be 0.5 mg/cm$^2$, to obtain a solid printing sample, which is then fixed by using a roll type fixing machine and adjusting the roll surface temperature to be 180° C. and the nipping time to be 40 msec. Immediately thereafter, the solid printing sample is cut into a strip, and the sample is weighed and put into a head space vial having a capacity of 20 ml so that the emulsion polymerized agglomerated toner amount will be 0.100 g (from 1.6 to 1.7 g as the sample), and the vial is sealed with a cap and subjected to a head space (HS)SPME-GC/MS measurement to measure the concentrations of the above-mentioned respective components.

In the (HS)SPME-GC/MS measuring method, the vial having the sample put in a head space vial having a capacity of 20 ml so that the emulsion polymerized agglomerated toner amount will be 0.100 g as mentioned above, is put in an oven at 35° C., and SPME fiber (75 μm Carboxen/Polydimethylsiloxane, manufactured by SPELCO) is inserted to let the fiber adsorb volatile components generated from the sample for 2 hours. Then, the fiber is subjected to thermal desorption at the injection port temperature of GC (Hewlett-Packard GasChromatograph HP6890) (GC Injection port 250° C., desorption time: 8 minutes). The components volatilized by this desorption are once collected by cooling the forward end of the GC column to −150° C., and then the collected portion is rapidly heated, whereupon the volatilized components are introduced to GC/MS (Hewlett-Packard Mass Sensitive Detector 5973) to carry out quantitative determination of aliphatic aldehydes and aliphatic acids. The detailed GC measurement conditions are as follows. The column is HP-INNOWAX (Polyethylene Glycol); the injection mode is splitless; the inlet port temperature is 250° C.; and the column temperature is 40° C.×15 min→5° C./min→250° C.×15 min. Further, the detailed MS (mass spectroscopy) measurement conditions are such that the source temperature is 230° C.; the quad temperature is 150° C.; the capturing mode is SCAN (1.95 Scan/sec); and Scan Mass Range: 14-400 amu.

As a method for converting the area ratios obtained by the above method to the weight ratios, calculation is carried out by using calibration curves of the respective components as follows.

Methanol solutions having concentrations up to about 100 μg/ml in the case of the aliphatic aldehydes or up to about 500 μg/ml in the case of the aliphatic acids, are stepwisely prepared, and 1 μL of each solution is taken into a vial in the same manner as the sample, followed by a HS/SPME-GC/MS measurement under the same conditions as for the sample. From the mass spectra and peak areas of the volatile components obtained by the above-mentioned head space HS)SPME-GC/MS measurement, and the calibration curve measurements, the odor substances present in the toner after the fixing are identified, and their amounts of emission are quantified.

Further, the amount of emission (ng) obtained with respect to each substance is divided by the volume of the head space vial (20 ml) to calculate the concentration of the volatile component.

Odor Index

The odor index is the sum of values obtained by dividing the respective contents of specific components in the toner measured by the above gas chromatography method by the respective odor threshold values of the specific components. And, the odor can be improved only with respect to one having such an odor index being low.

Specifically, the concentrations of volatile components calculated from the amounts of emission of odor substances measured by the above head space method are divided by the respective odor threshold values (ppm) to obtain values as order units (OU (ng/ml/ppm)). Then, the sum of the OU values of the odor substances in each toner sample is obtained, and it is used as the odor index.

The emulsion polymerized agglomerated toner of the present invention has an odor index of aliphatic aldehydes measured by the above measurement method being at most 300, preferably at most 200, more preferably at most 100. When the odor index of aliphatic aldehydes is within the above range, the toner can be made to have no odor offensive to people. With respect to the odor level of conventional products, the odor index of aliphatic aldehydes used to be usually at least 420, since, for example, the amount of a peroxide remaining in the latex of primary particles of a polymer was large, whereby wax, etc. were likely to be decomposed, and such decomposed products, etc. were likely to be oxidized.

Further, the emulsion polymerized agglomerated toner of the present invention has an odor index of 1-octanal being at most 280, preferably at most 240, more preferably at most 90.

The lower limit of the odor index of aliphatic aldehydes measured by gas chromatography, of the emulsion polymerized agglomerated toner of the present invention, is not particularly limited, but most preferably 0. However, from the industrial viewpoint, about 10 is the limit of the lower limit, and usually, the lower limit is 10 or higher.

Further, the emulsion polymerized agglomerated toner of the present invention preferably has the odor attributable to aliphatic acids also reduced. Namely, it is preferred to reduce the odor index of aliphatic acids. Specifically, the odor index of aliphatic acids is preferably at most 2, more preferably at most 1.5, further preferably at most 1.0.

The lower limit of the odor index of aliphatic acids measured by gas chromatography, of the emulsion polymerized agglomerated toner of the present invention is not particularly limited, but most preferably 0. However, from the industrial viewpoint, about 0.01 is the limit of the lower limit, and usually, the lower limit is 0.01 or higher.

In the present invention, the method for bringing the odor index of aliphatic aldehydes of the emulsion polymerized agglomerated toner to the above range, is not particularly limited. However, such can be accomplished by a method of reducing the peroxide during the polymerization in the after-mentioned production of a toner, or by optimizing the method of e.g. deaeration.

For example, with respect to the amount of the peroxide to be used, it is common to adjust the amount of the peroxide so that the peroxide value of the latex of primary particles of the polymer will be at most 30, more preferably at most 10. Here, the peroxide value is one identified by comparing a color of a POV test paper (peroxide value test paper) manufactured by SIBAT Co. after it is dipped in the latex for 10 seconds with the comparative samples of the colors and peroxide values annexed to the POV test paper manufactured by SIBAT Co. Namely, one exhibiting a pink color has a peroxide value of at most 10; one exhibiting a pale purple color has a peroxide value of higher than 10 and at most 30; and one exhibiting a dark blue color has a peroxide value of higher than 30.

When the peroxide value of the emulsion polymerized latex is adjusted to be within the above range, it is possible to reduce an odor offensive to people or an odor presenting an irritating odor. The reason is not clearly understood, but it is conceivable that by suppressing the residue of the peroxide, it is possible to suppress formation of substances having strong odors such as aliphatic aldehydes.

In the process for producing an emulsion polymerized agglomerated toner of the present invention, the lower limit of the peroxide value of the emulsion polymerized latex is not particularly limited, but most preferably 0. However, from the industrial viewpoint, about 1 is the limit of the lower limit, and accordingly, the lower limit is usually 1 or higher.

In the process of the present invention, the method for bringing the peroxide value to the above range, is not particularly limited. In a case where a redox initiator is employed, such may be accomplished by a method of reducing the oxidizing agent and/or increasing a reducing agent, or by a method of e.g. adding a polymerization inhibitor after the polymerization of the monomer to react it with the peroxide, using an initiator having a lower half life temperature during the polymerization of the monomer, leaving the system at a high temperature for a long time after completion of the polymerization to reduce the peroxide, or increasing the temperature after completion of the polymerization to reduce the peroxide.

The emulsion polymerized agglomerated toner of the present invention contains a binder resin containing a crosslinked component, and a colorant and may further contain wax, an electrification-controlling agent, other additives or auxiliary agents, etc., a the case requires.

Binder Resin

In the present invention, the binder resin to be used for the toner can be selected within a wide range including conventional ones. For example, a styrene resin, a saturated or unsaturated polyester resin, an epoxy resin, a polyurethane resin, a vinyl chloride resin, a polyethylene, a polypropylene, an ionomer resin, a silicone resin, a rosin-modified maleic acid resin, a phenol resin, a ketone resin, an ethylene/ethylacrylate copolymer, or a polyvinyl butyral resin, may, for example, be mentioned, and such binder resins may be used alone or in combination as a mixture of two or more of them. As a resin to be used particularly preferably in the present invention, a styrene resin or a polyester resin may be mentioned, and particularly preferred is a styrene resin.

The styrene resin may be a homopolymer or a copolymer containing styrene or a styrene-derivative, such as a polystyrene, a chloropolystyrene, a poly-α-methyl styrene, a styrene/chlorostyrene copolymer, a styrene/propylene copolymer, a styrene/butadiene copolymer, a styrene/vinyl chloride copolymer, a styrene/vinyl acetate copolymer, a styrene/maleic acid copolymer, a styrene/acrylate copolymer, a styrene/acrylate/acrylic acid copolymer, a styrene/acrylate/methacrylic acid copolymer, a styrene/methacrylate copolymer, a styrene/mechacrylate/acrylic acid copolymer, a styrene/methacrylate/methacrylic acid copolymer, a styrene/methyl α-chloroacrylate copolymer, or a styrene/acrylonitrile/acrylate copolymer. It may be their mixture. Here, the ester group for the acrylate or methacrylate is not particularly limited, but may, for example, be a $C_{1-8}$ hydrocarbon ester such as a methyl ester, an ethyl ester, a butyl ester, an octyl ester or a phenyl ester. Further, one having a part or whole of the above acrylic acid or methacrylic acid substituted by a substituted monocarboxylic acid such as α-chloroacrylic acid or α-bromoacrylic acid, an unsaturated dicarboxylic acid such as fumaric acid, maleic acid, maleic anhydride or monobutyl maleate, an anhydride thereof or a half ester thereof, may also be suitably used.

Among them, it is particularly preferably at least one binder resin selected from the group consisting of a styrene/acrylate copolymer, a styrene/acrylate/acrylic acid copolymer, a styrene/acrylate/methacrylic acid copolymer, a styrene/methacrylate copolymer, a styrene/methacrylate/acrylic acid copolymer and a styrene/methacrylate/methacrylic acid copolymer, since it is excellent from the viewpoint of the fixing property and durability when formed into a toner, and yet the electrostatic stability (particularly the negative electrostatic property) of the toner will be thereby improved, such being more preferred.

The softening point (hereinafter referred to as Sp) of the binder resin is usually preferably at most 150° C., more preferably at most 140° C., for fixing with a low energy. Further, such Sp is preferably at least 80° C., more preferably at least 100° C. from the viewpoint of a high temperature-resistant offset property and durability. Here, such Sp can be obtained as a temperature at the middle point of a strand from the initiation to the completion of the flow when 1.0 g of a sample is measured by a flow tester (CFT-500, manufactured by Shimadzu Corporation) with a nozzle of 1 mm×10 mm under conditions such that the load is 30 kg, the preheating time is 5 minutes at 50° C. and the temperature raising rate is 3° C./min.

Further, the glass transition point (hereinafter referred to as Tg) of the binder resin is usually preferably at most 80° C., more preferably a most 70° C., for fixing with a low energy. Further, such Tg is preferably at least 40° C., more preferably at least 50° C. from the viewpoint of an anti-blocking property. Here, such Tg can be obtained as a temperature at the intersection of two tangent lines when such tangent lines are drawn at the transition (change in curvature) starting portion of the curve measured under a condition of a temperature raising rate of 10° C./min by a differential scanning calorimeter (DTA-40, manufactured by Shimadzu Corporation).

In the present invention, Sp and Tg of the binder resin can be adjusted to the above ranges by adjusting the type of the resin and the compositional ratio of monomers, the molecular weight, etc. Further, it is also possible to properly select and use one having Sp and Tg within the above ranges among commercially available resins.

In a case where the above-mentioned styrene resin is used as the binder resin, such a binder resin preferably has a number average molecular weight by a gel permeation chromatography (hereinafter referred to as GPC), of at least 2,000, more preferably at least 2,500, further preferably at least 3,000 and preferably at most 50,000, more preferably at most 40,000, further preferably at most 35,000. Further, such a binder resin preferably has a weight average molecular weight obtained in the same manner, of at least 50,000, more preferably at least 100,000, further preferably at least 200,000 and preferably at most 2,000,000, more preferably at most 1,000,000, further preferably at most 500,000. When the number average molecular weight and the weight average molecular weight of the styrene resin are within the above ranges, the durability, storage stability and fixing property of the toner will be good, such being desirable. Here, the value of the average molecular weight by GPC is a value calculated by using monodisperse polystyrene as the standard sample.

The crosslinked component as an essential component in the emulsion polymerized agglomerated toner of the present invention can be prepared by using a crosslinkable monomer. Such a crosslinkable monomer is not particularly limited, but a polyfunctional monomer having radical polymerizability is employed. For example, divinylbenzene, hexanediol diacrylate, ethylene glycol dimethacrylate, diethylene glycol dimethacrylate, diethylene glycol diacrylate, triethylene glycol diacrylate, neopentyl glycol dimethacrylate, neopentyl glycol acrylate or diallyl phthalate may be mentioned. Further, it is possible to employ a monomer having a reactive group as a pendant group, such as glycidyl methacrylate, methylol acrylamide or acrolein. Preferred is a radical polymerizable bifunctional monomer, and further preferred is divinylbenzene or hexanediol diacrylate.

The blend ratio of such a crosslinkable monomer is preferably within a range of from 0.05 to 10 parts by weight, more preferably from 0.3 to 5 parts by weight, particularly preferably from 0.8 to 3 parts by weight, per 100 parts by weight of the binder resin. By using a crosslinkable monomer in such a manner, when the obtainable toner is used for forming an image, the high temperature offset will be good.

Colorant

The colorant to be used for the toner of the present invention may be any of an inorganic pigment or an organic pigment or dye, or a combination thereof. Specifically, it may, for example, be a metal powder such as iron powder or copper powder, a metal oxide such as red oxide, carbon black such as furnace black or lamp black, an acid dye or basic dye, such as a precipitate by a precipitating agent, of an azo dye such as benzidine yellow or benzidine orange, or a dye such as quinoline yellow, acid green or alkali blue, or a precipitate of a dye such as rhodamine, magenta or malachite green by e.g. tannic acid or phosphomolybdic acid, a mordant dye such as a metal salt of a hydroxyanthraquinone, an organic pigment such as a phthalocyanine pigment such as phthalocyanine blue or copper sulfonate phthalocyanine, a quinacridone pigment such as quinacridone red or quinacridone violet, or a dioxane pigment, or a synthetic dye such as aniline black, an azo dye, a naphthoquinone dye, an indigo dye, a nigrosine dye, a phthalocyanine dye, a polymethine dye, or a di- or tri-allylmethane dye. These colorants may be used in combination as a mixture of two or more of them.

An yellow colorant may specifically be a pigment such as C.I. pigment yellow, 3, 7, 10, 12, 13, 14, 15, 17, 23, 24, 60, 62, 74, 75, 83, 93, 94, 95, 99, 100, 101, 104, 108, 109, 110, 111, 117, 123, 128, 129, 138, 139, 147, 148, 150, 155, 166, 168, 169, 177, 179, 180, 181, 183, 185, 191:1, 191, 192, 193 or 199, or a dye such a C.I. solvent yellow 33, 56, 79, 82, 93, 112, 162, 163 or C.I. disperse yellow 42, 64, 201 or 211.

Magenta colorant may specifically be C.I. pigment 2, 3, 5, 6, 7, 23, 48:2, 48:3, 48:4, 57:1, 81:1, 122, 146, 150, 166, 169, 177, 184, 185, 202, 206, 220, 221, 238, 254, 255, 269 or C.I. pigment violet 19.

A cyan colorant may specifically be C.I. pigment blue 1, 7, 15, 15:1, 15:2, 15:3, 15:4, 60, 62 or 66.

In a case where the toner of the present invention is to be used for full color, the colorants to be used for the toner are preferably such that for yellow, benzidine yellow, monoazo dye or pigment or a condensed azo dye or pigment may be used; for magenta, quinacridone or a monoazo dye or pigment may be mentioned; and for cyan, phthalocyanine blue may be mentioned. The combination of the colorants may suitably be selected in consideration of the color, etc. However, among them, as an yellow colorant, C.I. pigment yellow 74 or C.I. pigment yellow 93 is preferably employed; as a magenta colorant, C.I. pigment red 238, C.I. pigment red 269, C.I. pigment red 57:1, C.I. pigment red 48:2 or C.I. pigment red 122 is preferably employed; and as a cyan colorant, C.I. pigment blue 15:3 is preferably employed.

The content of the above colorant may be an amount sufficient for the obtainable toner to form a visible image by development. For example, it is preferably within a range of from 1 to 25 parts by weight, more preferably from 1 to 15 parts by weight, particularly preferably from 3 to 12 parts by weight, in the toner.

Further, the above colorant may have magnetism. The magnetic colorant may be a ferromagnetic substance showing ferrimagnetism or ferromagnetism in the vicinity of from 0 to 60° C. which is the operation temperature of printers, copying machines, etc. Specifically, it may, for example, be magnetite ($Fe_3O_4$), maghematite ($\gamma$-$Fe_2O_3$), an intermediate or mixture of magnetite and maghematite, a spinel ferrite of the formula $M_xFe_{3-x}O_4$ wherein x is 1 or 2, and M is Mg, Mn, Fe, Co, Ni, Cu, Zn, Cd or the like, a hexagonal ferrite such as $BaO.6Fe_2O_3$ or $SrO.6Fe_2O_3$, a garnet oxide such as $Y_3Fe_5O_{12}$ or $Sm_3Fe_5O_{12}$, a rutile oxide such as $CrO_2$, or one showing magnetism at a temperature in the vicinity of from 0° C. to 60° C. among metals such as Cr, Mn, Fe, Co and Ni, and their ferromagnetic alloys. Among them, magnetite, maghematite or an intermediate of magnetite and maghematite is preferred. In a case where such a magnetic colorant is incorporated with a view to preventing scattering or controlling the electrostatic property, while the characteristics as a non-magnetic toner are maintained, the content of the magnetic powder in the toner is from 0.2 to 10 wt %, preferably from 0.5 to 8 wt %, more preferably from 1 to 5 wt %. Further, in a case where it is used as a magnetic toner, the content of the magnetic powder in the toner is usually at least 15 wt %, preferably at least 20 wt % and usually at most 70 wt %, preferably at most 60 wt %. If the content of the magnetic powder is less than the above range, there may be a case where no adequate magnetic power as a magnetic toner can be obtained, and if it exceeds the above range, such may cause a fixing failure.

In the present invention, in a case where an electrical conductivity is to be imparted to the toner, an electroconductive carbon black or other conductive substance may be incorporated as the above colorant component. The content of such a conductive substance is preferably at a level of from 0.05 to 5 wt % in the toner.

Electrification-Controlling Agent

To the toner of the present invention, an electrification-controlling agent may be added in order to adjust the electrostatic charge and to impart the electrostatic stability. A positively chargeable electrification-controlling agent may, for example, be a nigrosine dye, a quaternary ammonium salt, a triaminotriphenylmethane compound, an imidazole compound or a polyamine resin. A negatively chargeable electrification-controlling agent may, for example, be an azo complex compound dye containing an atom such as Cr, Co, Al, Fe or B, salicylic acid, an alkyl salicylic acid complex compound, a calix (n) arene compound, a metal salt or metal complex of benzilic acid, an amide compound, a phenol compound, a naphthol compound, a phenolamide compound, or a hydroxynaphthalene compound such as 4,4'-methylenebis[2-[N-(4-chlorophenyl)amido]-3-hydroxynaphthalene].

When the toner of the present invention is used for full color, it is necessary to choose the color of the electrification-controlling agent to be colorless or pale color in order to avoid a coloring trouble. For this purpose, the positively chargeable electrification-controlling agent is preferably a quaternary ammonium salt or an imidazole compound, and the negatively chargeable electrification-controlling agent is preferably salicyclic acid or an alkyl salicylic acid complex compound containing an atom such as Cr, Co, Al, Fe, B or Zn, or a calix (n) arene compound, among those mentioned above. Otherwise, it may be a mixture thereof. The amount of the electrification-controlling agent is preferably within a range of from 0.01 to 5 parts by weight, more preferably from 0.05 to 3 parts by weight, particularly preferably from 0.1 to 2 parts by weight in the toner.

Wax

For the toner of the present invention, wax may be employed. As such wax, known various types suitable for toners may be employed. Specifically, it may, for example, be an olefin wax such as a low molecular weight polyethylene, a low molecular weight polypropylene or a copolymer polyethylene; a paraffin wax; an ester type wax having a long chain aliphatic group such as behenyl behenate, a montanate or stearyl stearate; a plant wax such as hydrogenated castor oil, carnauba wax; candelira was, rice wax, haze wax or jojoba oil; a ketone having a long chain alkyl group such as distearyl ketone; a silicone wax; a higher fatty acid such as stearic acid and its metal salt; a long chain aliphatic alcohol such as eicosanol; a carboxylic acid or partial ester of a polyhydric alcohol obtained from a long chain fatty acid and a polyhydric alcohol such as glycerol or pentaerythritol; a higher fatty acid amide such as an oleic acid amide or stearic acid amide; or a low molecular weight polyester. These waxes may be employed in combination as a mixture of two or more of them.

The amount of wax to be incorporated, is preferably within a range of from 1 to 30 parts by weight, more preferably from 2 to 20 parts by weight, particularly preferably from 4 to 15 parts by weight, in the toner. If the content of the wax is less than the above range, the performance such as the low temperature fixing property, the high temperature offset property or the anti-blocking property may sometimes be inadequate, and if it exceeds the above range, the wax is likely to leak from the toner thereby to soil the device. As a method for incorporating the wax in an amount within the above range in the toner, it is preferred to produce the toner by the after-mentioned polymerization method, preferably by the emulsion polymerization flocculation method.

Among these waxes, in order to improve the fixing property, it is preferred that the wax has a melting point. The melting point of the wax is preferably at least 40° C., more preferably at least 50° C., particularly preferably at least 60° C. Further, it is preferably at most 120° C., more preferably at most 110° C., particularly preferably at most 100° C. If the melting point is too low, the wax is likely to be exposed on the surface thus presenting stickiness after the fixing, and if the melting point is too high, the fixing property at a low temperature tends to be poor.

As the compound species of the wax, a higher fatty acid ester wax, an olefin wax such as a copolymer polyethylene, or a paraffin wax is preferred. The higher fatty acid ester wax may specifically be preferably an ester of a $C_{15-30}$ aliphatic acid with a mono to pentahydric alcohol, such as behenyl behenate, stearyl stearate, a stearic acid ester of pentaerythritol, or montanic acid glyceride. Further, the alcohol component constituting the ester is preferably one having from 10 to 30 carbon atoms in the case of a monohydric alcohol, and is preferably one having from 3 to 10 carbon atoms in the case of a polyhydric alcohol. Further, a silicone wax is also preferred, and particularly preferred is an alkyl-modified silicone wax which is modified by an alkyl group.

Further, the toner of the present invention may contain various known additives such as a silicone oil, a silicone varnish or a fluorinated oil in the toner, for the purpose of modifying e.g. the adhesive property, agglomeration property, flowability, electrification property, surface resistance, etc. of the toner.

Production Method

Now, the method for producing the emulsion polymerized agglomerated toner of the present invention will be described in detail.

The method for producing the emulsion polymerized agglomerated toner of the present invention may be a conventional melt kneading pulverization method or a wet system method represented by a polymerization method, but from the viewpoint of the dispersibility of the fixing aid, it is preferred to produce the toner by a wet method.

Now, the emulsion polymerization flocculation method as the most preferred method for producing the toner of the present invention, will be described in detail.

In a case where the toner is produced by the emulsion polymerization flocculation method, it usually comprises a polymerization step, a mixing step, a flocculation step, an aging step and a washing and drying step.

Namely, to a dispersion containing primary particles of the polymer obtained by an emulsion polymerization, a dispersion of respective particles of a colorant, an electrification-controlling agent, wax, etc. is mixed; the primary particles in this dispersion are flocculated to form agglomerates of particles having a volume average particle size of from about 3 to 8 μm; if necessary, fine resin particles, etc. are deposited thereto; if necessary, the agglomerates of particles or the agglomerates of particles having the fine resin particles deposited thereon, are fused; and toner particles thus obtained are washed and dried to obtain toner particles as a product.

As the emulsifying agent to be used for the above emulsion polymerization, a known product may be employed. It is possible to employ at least one emulsifying agent selected from cationic surfactants, anionic surfactants and nonionic surfactants.

The cationic surfactants may, for example, be dodecylammonium chloride, dodecylammonium bromide, dodecyltrimethylammonium bromide, dodecylpyridinium chloride, dodecylpyridinium bromide and hexadecyltrimethylammonium bromide Further, the anionic surfactants may, for example, be a fatty acid soap such as sodium stearate or sodium dodecanoate, and an alkali metal salt of a linear alkylbenzenesulfonic acid, such as sodium dodecyl sulfate, sodium dodecylbenzene sulfonate, and sodium lauryl sulfate.

Further, the nonionic surfactants may, for example, be polyoxyethylene dodecyl ether, polyoxyethylene hexadecyl ether, polyoxyethylene nonylphenyl ether, polyoxyethylene lauryl ether, polyoxyethylene sorbitan monooleate ether and monodecanoyl sucrose.

Among these surfactants, an alkali metal salt of a linear alkylbenzenesulfonic acid is preferred.

The amount of the emulsifying agent is usually from 0.1 to 10 parts by weight per 100 parts by weight of the polymerizable monomer. Further, to such an emulsifying agent, one or more of polyvinyl alcohols such as partially or completely saponified polyvinyl alcohols, or cellulose derivatives such as hydroxyethyl cellulose, may be used in combination as a protective colloid.

Latex of Primary Particles of the Polymer

Primary particles of the polymer to be used for the emulsion polymerization flocculation method preferably have a glass transition temperature (Tg) of from 40 to 80° C. and an average particle size of usually from 0.02 to 3 μm. Such primary particles of the polymer are obtainable by emulsion polymerization of a monomer.

The method for their preparation is not particularly limited, but preferred are primary particles obtained by using fine particles of wax as seeds and subjecting a monomer mixture to seed emulsion polymerization.

In the emulsion polymerization, it is preferred to use a monomer having a Brønsted acidic group (hereinafter sometimes referred to simply as an acidic monomer) or a monomer having a Brønsted basic group (hereinafter sometimes referred to simply as a basic monomer), and a monomer having neither Brønsted acidic group nor Brønsted basic group (hereinafter sometimes referred to simply as other monomer), in combination, and these monomers may sequentially be added to carry out the polymerization. At that time, the respective monomers may be added separately, or a plurality of monomers may be preliminarily mixed and simultaneously added. Further, it is possible that during the addition of the monomers, the monomer composition may be changed. Further, the monomers may be added as they are, or they may be added in the form of an emulsion preliminarily mixed and adjusted with water, an emulsifying agent, etc. As the emulsifying agent, one or more may be selected for use among the above-mentioned surfactants.

The monomer having a Brønsted acidic group to be used in the present invention may, for example, be a monomer having a carboxyl group such as acrylic acid, methacrylic acid, maleic acid, fumaric acid or cinnamic acid, a monomer having a sulfonate group such as styrene sulfonate, or a monomer having a sulfonamide group such as vinylbenzene sulfonamide.

Further, the monomer having a Brønsted basic group may, for example, be an aromatic vinyl compound having an amino group, such as aminostyrene, a monomer containing a nitrogen-containing heterocyclic ring such as vinylpyridine or vinylpyrrolidone, or a (meth)acrylate having an amino group such as dimethylaminoethyl acrylate or diethylaminoethyl methacrylate.

Further, such a monomer having an acidic group and a monomer having a basic group may, respectively, be present in the form of a salt accompanying a counter ion.

The blend ratio of such a monomer having a Brønsted acidic group or a Brønsted basic group in the monomer mixture constituting the primary particles of the polymer, is preferably within a range of from 0 to 10 parts by weight, more preferably from 0 to 3 parts by weight, particularly preferably from 0 to 1.5 parts by weight, per 100 parts by weight of the binder resin. Among monomers having a Brønsted acidic group or Brønsted basic group, acrylic acid or methacrylate acid is particularly preferred.

Other monomers may, for example, be a styrene such as styrene, methylstyrene, dimethylstyrene, chlorostyrene, dichlorostyrene, p-tert-butylstyrene, p-n-butylstyrene or p-n-nonylstyrene, a (meth)acrylate such as methylacrylate, ethyl acrylate, propyl acrylate, n-butyl acrylate, isobutyl acrylate, hydroxyethyl acrylate, ethylhexyl acrylate, methyl methacrylate, ethyl methacrylate, propyl methacrylate, n-butyl methacrylate, isobutyl methacrylate, hydroxyethyl methacrylate or ethylhexyl methacrylate, acrylamide, N-propylacrylamide, N,N-dimethylacrylamide, N,N-dipropylacrylamide, N,N-dibutylacrylamide, acrylic acid amide, vinyl acetate, vinyl propionate, vinyl butyrate, vinyl benzoate, vinyl methyl ether, vinyl ethyl ether, vinyl isobutyl ether, vinyl methyl ketone, vinyl hexyl ketone, or vinyl isopropyl ketone. Among them, particularly preferred is, for example, styrene or butyl acrylate.

In a case where the toner is produced by an emulsion polymerization flocculation method, it is particularly preferred to use at least styrene as a copolymerizable component and to use at least one of acrylic acid, methacrylic acid and alkyl acrylate or methacrylate as a copolymerizable component.

Further, in a case where a crosslinked resin is used for the primary particles of the polymer, a radical polymerizable polyfunctional monomer is employed as a crosslinking agent to be used in combination with the above-described monomer. It may, for example, be divinylbenzene, hexanediol diacrylate, ethylene glycol dimethacrylate, diethylene glycol dimethacrylate, diethylene glycol diacrylate, triethylene glycol diacrylate, neopentyl glycol dimethacrylate, neopentyl glycol acrylate or diallyl phthalate. Further, it is also possible to use a monomer having a reactive group as a pendant group, such as glycidyl methacrylate, methylol acrylamide or acrolein. Preferred is radical polymerizable bifunctional monomer, and particularly preferred is divinylbenzene or hexanediol diacrylate.

The blend ratio of such a polyfunctional monomer in the monomer mixture is preferably within a range of from 0.05 to 10 parts by weight, more preferably from 0.1 to 5 parts by weight, particularly preferably from 0.2 to 3 parts by weight, per 100 parts by weight of the binder resin. By using the polyfunctional monomer in such a manner, when an image is formed by using the obtainable toner, the high temperature offset is likely to be excellent.

These monomers may be used alone or in combination as a mixture. At that time, it is preferred to adjust so that the glass transition temperature of the obtainable polymer will be from 40 to 80° C. If the glass transition temperature exceeds 80° C., the fixing temperature tends to be too high, or deterioration in the transparency in e.g. full color is likely to be problematic. On the other hand, if the glass transition temperature of the polymer is lower than 40° C., the storage stability of the toner is likely to be poor. The glass transition temperature is more preferably from 50 to 70° C., particularly preferably from 55 to 65° C.

Polymerization Initiator

The polymerization initiator may, for example, be hydrogen peroxide; a persulfate such as potassium persulfate, sodium persulfate or ammonium persulfate, and a redox initiator having such a persulfate as one component combined with a reducing agent such as acidic sodium sulfite; a water-soluble polymerization initiator such as 4,4'-azobiscyanovaleric acid, 4-butyl hydroperoxide or cumene hydroperoxide, and a redox initiator having such a water-soluble polymerization initiator as one component combined with a reducing agent such as a ferrous salt; an azo compound such as 2,2'-azobisisobutyronitrile, 2,2'-azobis-2,4-dimethylvaleronitrile, 1,1'-azobis(cyclohexane-1-carbonitrile), or 2,2'-azobis-4-methoxy-2,4-dimethylvaleronitrile; or an organic peroxide, for example, a peroxide initiator such as acetylcyclohexylsulfonyl peroxide, diisopropyl peroxycarbonate, decanoyl peroxide, lauroyl peroxide, stearoyl peroxide, propionyl peroxide, acetyl peroxide, t-butyl peroxy-2-ethyl hexanoate, benzoyl peroxide, t-butyl peroxyisobutyrate, cyclohexanone peroxide, methyl ethyl ketone peroxide, dicumyl peroxide, t-butyl hydroperoxide, di-t-butyl peroxide, or cumene hydroperoxide. One or more of such initiators are usually used in an amount of from 0.1 to 3 parts by weight per 100 parts by weight of the polymerizable monomers. Among them, hydrogen peroxide, an organic peroxide or an azo compound is preferred as the initiator. Such a polymerization initiator may be added to the polymerization system at any time i.e. before, at the same time as or after the addition of monomers, and if necessary, these methods for addition may be used in combination.

Further, one or more suspension stabilizers such as potassium phosphate, magnesium phosphate, calcium hydroxide and magnesium hydroxide, may be employed usually in an amount of from 1 to 10 parts by weight per 100 parts by weight of the polymerizable monomers.

The polymerization initiator and the suspension stabilizer may, respectively, be added to the polymerization system at any time i.e. before, at the same as or after the addition of monomers, and if necessary, these methods for addition may be used in combination.

At the time of emulsion polymerization, a known chain transfer agent may be used as the case requires. Specific examples of such a chain transfer agent include t-dodecyl mercaptan, 2-mercaptoethanol, diisopropyl xanthogen, carbon tetrachloride and trichlorobromomethane. Such chain transfer agents may be used alone or in combination as a mixture of two or more of them. The chain transfer agent is employed usually within a range of at most 5 wt %, based on the entire monomers.

In the emulsion polymerization, the above monomers are mixed with water and polymerized in the presence of a polymerization initiator. The polymerization temperature is usually from 40 to 150° C., preferably from 50 to 120° C., more preferably from 60 to 100° C.

Further, in the emulsion polymerization, addition of the above polymerizable monomers to the reaction system may be addition all at once, continuous addition or intermittent addition, but continuous addition is preferred from the viewpoint of control of the reaction. Further, in a case where a plurality of monomers are to be used, the respective monomers may be separately added, or the plurality of monomers may be preliminarily mixed and simultaneously added. Further, during the addition of monomers, the monomer composition may be changed. Further, the addition of the above-mentioned emulsifying agent to the reaction system may also be addition all at once, continuous addition or intermittent addition. Further, in addition to the above emulsifying agent and the above polymerization initiator, a pH-controlling agent, a polymerization degree-adjusting agent, a defoaming agent, etc., may be added to the reaction system, as the case requires.

The volume average particle diameter of the primary particles of the polymer thus obtained is usually within a range of from 0.02 μm to 3 μm, preferably from 0.02 μm to 30 μm, more preferably from 0.05 μm to 3 μm, particularly preferably from 0.1 μm to 1.5 μm. Here, the average particle diameter may be measured, for example, by means of UPA. If the particle diameter is smaller than 0.02 μm, control of the flocculation rate tends to be difficult, such being undesirable. On the other hand, if it is larger than 3 μm, the particle diameter of the toner obtained by flocculation tends to be large, such being not suitable for the production of a toner of from 3 to 8 μm. Here, the volume average particle diameter may be measured, for example, by means of Microtrac UPA, manufactured by NIKKISO CO., LTD.

In the emulsion polymerization, the above-mentioned monomers are polymerized in the presence of a polymerization initiator, and the polymerization temperature is usually from 50 to 120° C., preferably from 60 to 100° C., further preferably from 70 to 90° C.

As the primary particles of the polymer in the present invention, a plurality of primary particles of different polymers obtained as described above may be used in combination. Further, in the method of the present invention, a resin obtained by a polymerization method different from emulsion polymerization may be used in combination as primary particles of the polymer, and as such a resin, it is preferred to employ one having a volume average particle size of usually at least 0.02 μm, preferably at least 0.05 μm, more preferably at least 0.1 μm and usually at most 3 μm, preferably at most 2 μm, more preferably at most 1 μm.

In the emulsion polymerization flocculation method, a dispersion of primary particles of the polymer and colorant particles are mixed to obtain a mixed dispersion, which is then flocculated to obtain agglomerates of particles. The colorant is preferably employed in a state of emulsion as emulsified in water in the presence of an emulsifying agent (the above-described surfactant), and the volume average particle diameter of the colorant particles is preferably from 0.01 to 3 μm, more preferably from 0.05 μm to 3 μm, particularly preferably from 0.1 μm to 3.0 μm.

The amount of the colorant is usually from 1 to 25 parts by weight, preferably from 1 to 15 parts by weight, more preferably from 3 to 12 parts by weight, per 100 parts by weight of the primary particles of the polymer.

In the emulsion polymerization flocculation method, wax is preferably employed in the form of a dispersion of emulsified fine particles of wax as preliminarily dispersed in the presence of an emulsifying agent (the above-mentioned surfactant).

Wax is present in the flocculation step. There is a case where a dispersion of fine particles of wax is co-flocculated together with primary particles of the polymer and colorant particles, or a case wherein in the presence of a dispersion of fine particles of wax, a monomer is subjected to seed emulsion polymerization to prepare primary particles of a polymer having the wax included, and such primary particles are flocculated together with colorant particles.

In order to uniformly disperse the wax in the toner, it is preferred to let the dispersion of fine particles of wax be present during the preparation of the primary particles of the polymer i.e. during the polymerization of the monomers.

The average particle diameter of fine particles of wax is preferably from 0.01 μm to 3 μm, more preferably from 0.1 μm to 2 μm, particularly preferably from 0.1 μm to 1.5 μm. The average particle diameter can be measured by means of e.g. LA-500, manufactured by Horiba, Ltd. If the average particle diameter of the wax emulsion is larger than 3 μm, control of the particle diameter during the flocculation tends to be difficult. Further, if the average particle diameter of the emulsion is smaller than 0.01 μm, preparation of a dispersion tends to be difficult.

As a method for incorporating an electrification-controlling agent in the emulsion polymerization flocculation method, the electrification-controlling agent may be used as seeds together with wax or the electrification-controlling agent may be used as dissolved or dispersed in a monomer or wax at the time of obtaining primary particles of the polymer; primary particles of the electrification-controlling agent may be flocculated together with primary particles of a polymer and a colorant to form agglomerates of particles; or primary particles of a polymer and a colorant may be flocculated to a particle size almost suitable for a toner, whereupon primary particles of the electrification-controlling agent may be added and flocculated.

In such a case, it is preferred that also the electrification-controlling agent is dispersed in water by means of an emulsifying agent (the above-mentioned surfactant) and is used in the form of an emulsion having an average particle diameter of from 0.01 to 3 μm (primary particles of the electrification-controlling agent). More preferably, one having an average particle diameter of from 0.05 to 3 μm, particularly from 0.1 to 3.0 μm, may suitably be employed.

Mixing Step

In the flocculation step in the process of the present invention, the above-mentioned particles of blend components such as the latex of primary particles of the polymer, the colorant particles, the optional electrification-controlling agent and wax, may be mixed simultaneously or sequentially. However, it is preferred to obtain a mixed dispersion by preliminarily preparing separate dispersions of the respective components, i.e. the latex of primary particles of the polymer, a dispersion of the colorant particles, an optional dispersion of an electrification-controlling agent and an optional dispersion of fine particles of wax and mixing them.

Further, the wax is preferably incorporated to the toner by using one included in the primary particles of the polymer i.e. the primary particles of the polymer emulsion-polymerized by using wax as seeds. In such a case, the wax included in the primary particles of the polymer and fine particles of wax not so included, may be used in combination. However, it is further preferred to use it in such a form that substantially the entire amount of wax is included in the primary particles of the polymer.

Flocculation Step

The above-mentioned mixed dispersion of various particles is flocculated in a flocculation step to form agglomerates of particles. Such a flocculation step may be carried out by 1) a method of heating for flocculation, 2) a method of adding an electrolyte for flocculation an 3) a method of adjusting pH for flocculation.

In a case where the flocculation is carried out by heating, the flocculation temperature is specifically within a range of from 40° C. to Tg+10° C. (where Tg is the glass transition temperature of the primary particles of the polymer), preferably within a range of from Tg−10° C. to Tg+5° C., more preferably within a range of from Tg−10° C. to Tg. Within such a temperature range, the flocculation can be carried out to attain a preferred toner particle size without using an electrolyte.

Further, in a case where the flocculation is carried out by heating, if an aging step is to be carried out following the flocculation step, the flocculation step and the aging step may be carried out continuously, and the boundary may not be distinct. However, if a step is present where the temperature is maintained within a range of from Tg−20° C. to Tg for at least 30 minutes, such a step may be regarded as a flocculation step.

The flocculation temperature is preferably maintained for at least 30 minutes at a prescribed temperature to obtain toner particles having a desired particle size. To such a prescribed temperature, the temperature may be raised at a constant rate, or the temperature may be raised stepwise. The retention time is preferably from 30 minutes to 8 hours, more preferably from 1 hours to 4 hours, within a range of Tg−20 to Tg. In such a manner, it is possible to obtain a toner having a small particle diameter and a sharp particle size distribution.

Further, in a case where an electrolyte is added to the mixed dispersion to carry out the flocculation, the electrolyte may be an organic salt or inorganic salt, but preferably, a monovalent or polyvalent metal salt is preferably employed. Specifically, NaCl, KCl, LiCl, $Na_2SO_4$, $K_2SO_4$, $Li_2SO_4$, $MgCl_2$, $CaCl_2$, $MgSO_4$, $CaSO_4$, $ZnSO_4$, $Al_2(SO_4)_3$, $Fe_2(SO_4)_3$, $CH_3COONa$, or $C_6H_5SO_3Na$ may, for example, be mentioned. Among them, an inorganic salt having a bivalent or higher polyvalent metal cation, is preferred.

The amount of the electrolyte varies depending upon the type of the electrolyte, but usually from 0.05 to 25 parts by weight, preferably from 0.05 to 15 parts by weight, more preferably from 0.1 to 10 parts by weight, per 100 parts by weight of the solid component of the mixed dispersion, is used.

If the amount of the electrolyte is substantially smaller than the above range, the progress of the flocculation reaction tends to be slow, and a problem is likely to result such that even after the flocculation reaction, a fine powder of at most 1 μm is likely to remain, and the average particle diameter of the obtained agglomerates of particles tends to be at most 3 μm. Further, if the amount of the electrolyte is substantially larger than the above range, the flocculation tends to be rapid and difficult to control, a coarse powder of at least 25 μm tends to be mixed in the obtained agglomerates of particles, and the shape of agglomerates tends to be deformed or irregular.

Further, in a case where the electrolyte is added to the mixed dispersion to carry out the flocculation, the flocculation temperature is preferably within a range of 5° C. to Tg.

Other Blend Components

In the present invention, it is preferred to have fine particles of a resin coated (deposited or fixed) on the surface of the agglomerates of particles after the above flocculation treatment, to form toner particles.

Further, in a case where the above-described electrification-controlling agent is added after the flocculation treatment, fine particles of a resin may be added after adding the electrification-controlling agent to the dispersion containing the agglomerates of particles.

As the fine particles of a resin, it is possible to use ones having a volume average particle diameter of preferably from 0.02 to 3 μm, more preferably from 0.05 to 1.5 μm, particularly preferably from 0.05 to 1.0 μm and obtained by polymerizing a monomer similar to the monomer employed for the above-mentioned primary particles of a polymer. Further, in such fine particles, wax may be incorporated by a method such as seed polymerization at the time of producing such fine particles of the resin, and other than such wax, various substances may be incorporated for the purpose of modifying the surface property. In a case where fine particles of a resin are coated on the agglomerates of particles to form a toner, the resin to be used for the fine particles of a resin is preferably a crosslinked one.

Aging Step

In an emulsion polymerization/flocculation method, in order to increase the stability of agglomerates of particles (toner particles) obtained by flocculation, it is preferred to add an aging step to cause fusion among agglomerated particles within a range of from Tg+20° C. to Tg+80° C. (where Tg is the glass transition temperature of the primary particles of the polymer), more preferably within a range of from Tg+20° C. to Tg+70° C., particularly preferably within a range of from Tg+20° C. to Tg+60° C. Further, in this aging step, the agglomerates are preferably held for at least one hour in the above temperature range. By adding such an agent step, the shape of the toner particles can be made close to spherical, and it will be possible to control the shape. The aging step is preferably usually from 0.1 hour to 10 hours, more preferably from 0.1 to 5 hours, still further preferably from 0.1 to 3 hours.

The agglomerates of particles before the aging step are considered to be agglomerates by electrostatic or other physical flocculation of primary particles, but after the aging step, the primary particles of the polymer constituting the agglomerates of particles are fused to one another, preferably to form substantially a spherical shape. Further, by such a method for producing a toner, it is possible to produce toners having various shapes (spherical degrees) depending upon the particular purposes, such as a grape type wherein the primary particles are flocculated, a potato type wherein the fusion is advanced to a half way and a spherical shape wherein the fusion is further advanced. Further, in a case where flocculation is carried out in multi stages as mentioned above, it is possible to carry out a flocculation step again after the aging step. Also in such a case, it is preferred to carry out the aging step again.

Washing and Drying Step

The agglomerates of particles obtained via the above-described various steps, are subjected to solid/liquid separation in accordance with a known method to recover the agglomerates of particles, which are then washed and dried, as the case requires, to obtain the desired toner particles.

In such a manner, it is possible to produce a toner having a relatively small particle diameter with a volume average particle diameter of from 3 to 8 μm. Yet, the toner obtained in such a manner has a particle side distribution which is sharp and is one suitable as an emulsion polymerized agglomerated toner to attain a high image quality and high speed. Here, the particle diameter of the base particles of the toner is meant for a value measured by means of a Multisizer (manufactured by Coulter).

To the toner to be used in the present invention, a known auxiliary agent may be added in order to control the flowability or the developing property. Such an auxiliary agent may, for example, be various inorganic oxide particles such as silica, alumina or titania (subjected to hydrophobizing treatment, as the case requires), or particles of a vinyl polymer, or they may be used in combination. The amount of such an auxiliary agent is preferably within a range of from 0.05 to 5 parts by weight, based on the toner particles. A method for adding the auxiliary agent to the toner is not particularly limited, and it is possible to use a mixing machine which is commonly used for the production of the toner. For example, by a mixing machine such as a Henschel mixer, a V-type blender or a Loedige Mixer, it can be uniformly stirred and mixed to the toner.

The emulsion polymerized agglomerated toner of the present invention thus obtained has a volume average particle diameter (Dv) of usually from 3 to 8 μm, preferably from 4 to 8 μm, more preferably from 4 to 7 μm. If the volume average particle diameter is too large, such is not suitable for forming an image with a high resolution, and if it is too small, handling as a powder tends to be difficult. For the measurement of the particle diameter of the toner, a commercially available particle size measuring device may be employed, but typically, a precise particle size distribution measuring device manufactured by Beckman Coulter, Inc. i.e. Coulter Counter, Multisizer II, may be employed.

The toner preferably has little fine particles (fine powder). When fine particles are little, the flowability of the toner will be improved, and the colorant, the antistatic agent, etc. can be uniformly distributed, whereby the electrification can easily be made uniform. As the emulsion polymerized agglomerated toner of the present invention, it is preferred to employ a toner whereby the measured value (the number) of particles of from 0.6 μm to 2.12 μm by a flow type particle image analyzer is at most 15% of the total number of particles. This means that the amount of fine particles is smaller than a certain level, and it is preferred that the number of particles of from 0.6 μm to 2.12 μm is further preferably at most 10%, particularly preferably at most 5%. Further, there is no lower limit for the number of such particles. It is most preferred that no such fine particles exist, but such is practically difficult, and about 0.5% is the limit of the lower limit. Thus, the lower limit is usually at least 1%.

The emulsion polymerized agglomerated toner of the present invention is preferably one wherein the relation between the volume average particle diameter (Dv) and the number average particle diameter (Dn) is $1.0 \leq Dv/Dn \leq 1.3$, more preferably $1.0 \leq Dv/Dn \leq 1.2$, particularly preferably $1.0 \leq Dv/Dn \leq 1.1$. Further, the lower limit of Dv/Dn is 1, but this means that all particle diameters are equal. To attain such a particle size distribution, it is particularly preferred to carry out the production by an emulsion polymerization flocculation method. A toner having a sharp particle size distribution is advantageous for forming a highly fine image as the colorant, since the electrification-controlling agent, etc., can be more uniformly distributed so that the electrification will be uniform. Further, the measurement of the number average particle diameter (Dn) is carried out in the same manner as for Dv.

With respect to the degree of circularity of the toner, the average circularity is preferably from 0.9 to 1.0, more preferably from 0.93 to 0.98, particularly preferably from 0.94 to 0.98. Here, the average circularity typically corresponds to an average circularity obtained by a formula (degree of circularity=perimeter of a circle having the same area as the projective area of particle/perimeter of the projected image of the particle) by measuring the toner by a flow type particle image analyzer FPIA-2000 manufactured by Sysmex Corporation. If the degree of circularity is less than the above range, the transfer efficiency tends to be poor and the reproducibility of dots tends to be low, and if it exceeds the above range, a non-transferred toner remaining on the photoreceptor may not be completely scraped off, and an image defect is likely to result.

The toner of the present invention may be applied to any of a two component developer, a magnetic one component developer such as a magnetite-containing toner, and a non-magnetic one component developer.

In a case where it is used for a two component developer, the carrier to be mixed with the toner to form the developer, may, for example, be a known magnetic material such as an iron powder type, ferrite type or magnetite type carrier, or one having a resin coating applied to the surface thereof, or a magnetic resin carrier. As the coating resin for the carrier, a styrene resin, an acrylic resin, a styrene/acrylic copolymer resin, a silicone resin, a modified silicone resin or a fluororesin, which is commonly known, may be used, but it is not limited thereto. The average particle diameter of the carrier is not particularly limited, but it is preferably one having an average particle diameter of from 10 to 200 μm. Such a carrier is preferably used in an amount of from 5 to 100 parts by weight per one part by weight of the toner.

As described in the foregoing, the emulsion polymerized agglomerated toner of the present invention is one which is excellent in the fixing property even at a high temperature without deteriorating other various properties and which has an excellent performance not to emit an odor offensive to people, and the method for producing an emulsion polymerized agglomerated toner for an electrostatic image of the present invention is capable of efficiently producing such a toner and thus has an extremely high value for industrial applicability.

EXAMPLES

Now, the present invention will be described in further detail with reference to Examples, but it should be understood that the present invention is by no means restricted by the following Examples.

In the following Examples, "parts" means "parts by weight". The determination of the average particle diameter, average circularity, peroxide value and odor indices of aliphatic aldehydes and aliphatic acids, and the odor panel test, were carried out by the following methods.

Volume Average Particle Diameter and Number Average Particle Diameter

The average particle diameters of the dispersed colorant particles and the primary particles of the polymer were measured by using Microtrac (hereinafter referred to simply as UPA) manufactured by Nikkiso Co., Ltd. and setting, as the measuring conditions, the temperature to be 25° C., the measuring time to be 100 seconds, the number of measurements to be once, the refractive index of particles to be 1.59, the transmittance to be transmitting, the shape to be spherical and the density to be 1.04. The average particle diameter of the toner was measured by Coulter Counter Multisizer II model (hereinafter referred to simply as Coulter Counter) manufactured by Coulter by using an aperture diameter of 100 μm.

Average Circularity

Using a flow type particle image analyzer FPIA-2000, manufactured by TOA MEDICAL ELECTRONICS CO., LTD., the toner was dispersed in Cell Sheath as a standard diluting liquid, and from 2,000 to 2,500 toner particles were measured, whereupon an average circularity as a value obtained by the following formula (I) was adopted.

Average circularity=Peripheral length of a circle having the same area as the projected area of a particle/Peripheral length of the projected image of the particle (I)

Peroxide Value

The peroxide value of the latex of primary particles of a polymer was examined by the following method.

A POV test paper (a peroxide value test paper) manufactured by SIBAT was immersed in the latex for 10 seconds, and the color thereby exhibited by the test paper was compared with comparative samples attached to the POV test paper manufactured by SIBAT, whereby the peroxide value (K) was identified as follows.

Pink color peroxide value: at most 10 (K≤10)

Pale purple color peroxide value: higher than 10 and at most 30 (10<K≤30)

Dark blue color peroxide value: higher than 30 (30<K)

Method for Calculation of Odor Indices of Aliphatic Aldehydes and Aliphatic Acids Preparation of Test Sample To 100 parts of the obtained toner base particles, 0.5 part of fine particles of silica having an average primary particle size of 0.04 μm, subjected to hydrophobic treatment with silicone oil and 2.0 parts of fine particles of silica having an average primary particle size of 0.012 μm, subjected to hydrophobic treatment with silicone oil, were added, followed by stirring and mixing by a Henschel mixer to obtain a developer toner, which was developed on a paper (FC dream paper, manufactured by Kishu Kishu Paper Co., Ltd.) so that it would be 0.5 mg/cm$^2$. Further, this developed toner was fixed by using a roll type fixing machine and adjusting the roll surface temperature to be 180° C. and the nipping time to be 40 msec. This solid printing sample was cut into a strip shape, and the sample was weighed and put in a head space vial having a capacity of 20 ml so that the amount of the emulsion polymerized agglomerated toner would be 0.100 g (from 1.6 to 1.7 g as the sample), whereupon the vial was sealed with a cap.

Head Space (HS) SPME-GC/MS Measurement

This vial was put into an oven of 35° C., and SPME fiber (75 μm Carboxen/Polydimethylsiloxane, manufactured by SPELCO) was inserted, whereupon a volatile component emitted from the sample was adsorbed by the fiber for 2 hours. Then, the fiber was subjected to thermal desorption at the temperature of the injection port of GC (Hewlett-Packard Gas Chromatograph HP6890) (GC Injection port: 250° C., desorption time: 8 minutes). The component evaporated by this desorption was once collected by cooling the forward end of the GC column to −150° C., and then by rapidly heating the collected portion, the volatile component was introduced into GC/MS (Hewlett-Packard Mass Sensitive Detector 5973) to carry out quantitative analyses of aliphatic acids. (GC measurement conditions: the column was HP-INNOWAX (Polyethylene Glycol), the injection mode was splitless, the injection port temperature was 250° C., and the column temperature was 40° C.×15 min→5° C./min→250° C.×15 min) (MS measurement conditions: the source temperature was 230° C., the quad temperature was 150° C., the capturing mode was SCAN (1.95 Scan/sec), Scan Mass Range: 14 to 400 amu)

Calibration Curves

With respect to $C_{1-10}$ aliphatic aldehydes, methanol solutions having concentrations of up to about 100 μg/ml were stepwisely prepared, and with respect to benzaldehyde and $C_{1-10}$ aliphatic acids, methanol solutions having concentrations of up to about 500 μg/ml were stepwisely prepared. 1 μL of such a solution was put into a vial in the same manner as the test sample, and the HS/SPME-GC/MS measurement was carried out under the same conditions as for the test sample.

From the mass spectra and peak areas of volatile components obtained by the above head space (HS)SPME-GB/MS measurement and the measurement of calibration curves, the odor substances present in the toner after the fixing were identified, and the amounts of their emission were quantified. Values obtained by dividing the obtained amounts of emission of the respective substances (ng/ml) by the respective odor threshold values, were taken as order units (OU), and the sum of OU values of the odor substances in each toner sample was obtained, and it was taken as the odor index.

Endothermic Main Peak by the DSC Curve of Emulsion Polymerized Toner

The measuring method is in accordance with ASTM D3418-82. The DSC curve to be used in the present invention is a DSC curve measured when after raising the temperature from 30 to 210° C. at a temperature raising rate of 10° C./min to remove a preliminary history, the temperature is lowered at a temperature lowering rate of 20° C./min within a temperature range of from 210 to 30° C. and further the temperature is raised from 30 to 110° C. at a rate of 10° C./min. And, the endothermic main peak temperature is meant for the peak top temperature of the obtained DSC curve Odor Panel Test The obtained emulsion polymerized agglomerated toner was developed on a paper so that it would be 1.0 mg/cm$^2$. Further, this toner was fixed by using a roll type fixing machine and adjusting the roll surface temperature to be 180° C. and the nipping time to be 40 msec. Ten sheets of paper immediately after the fixing were put into a glass container, which was then sealed and left to stand for 1 day. The container was opened, whereby the degree of odor was judged by ten people on such basis that "no substantial offensive odor is smelled" is rated to have five points, "slight odor is smelled but is not offensive" is rated to have three points, and "an offensive odor is strongly smelled" is rated to have one point, and the evaluation was made as follows.

When the total points by ten people were:

| | | |
|---|---|---|
| At least 40 points | Excellent | ◎ |
| At least 30 points and less than 40 points | Good | ○ |
| Less than 30 points | Bad | X |

High Temperature Offset Test

On an A4 paper sheet, 0.06 g of the obtained emulsion polymerized agglomerated toner was put in an area of 100 cm$^2$. Then, the fixing temperature was raised at intervals of 5° C. between 140° C. to 220° C., whereby the fixing state at each fixing temperature was visually evaluated.

| | |
|---|---|
| No offset observed (no toner stain is observed outside the fixing portion of the toner) | ○ |
| Slight offset observed (slight toner stain is observed outside the fixing portion of the toner) | Δ |
| Offset observed (toner stain is distinctly observed outside the fixing portion of the toner) | X |

Example 1

Preparation of Wax Dispersion A

30 Parts of a paraffin wax (HNP-9 manufactured by NIPPON SEIRO CO., LTD., surface tension: 23.5 mN/m, melting point: 82° C., heat of fusion: 220 J/g, half value width of fusion peak: 8.2° C., half value width of crystallization peak: 13.0° C.), 2.8 parts of a 20% anionic surfactant (Neogen S20A, manufactured by DAI-ICHI KOGYO SEIYAKU CO., LTD.) and 67.2 parts of deionized water were heated to 90° C. and stirred for 10 minutes by a disperser. Then, this dispersion was heated to 100° C., and using a homogenizer (15-M-8PA model, manufactured by GAULIN), emulsifying was initiated under a pressure condition of about 15 MPa, and while measurement was carried out by a particle size distribution meter, dispersion was carried out to bring the volume average particle diameter to 200 nm to prepare a wax dispersion A.

Preparation of Wax Dispersion B

27 Parts of an alkyl-modified silicone wax having a following structure (1) (surface tension: 27 mN/m, melting point: 63° C., heat of fusion: 97 J/g, half value width of fusion peak: 10.9° C., half value width of crystallization peak: 17.0° C.), 0.3 part of an anionic surfactant (Neogen SC, manufactured by DAI-ICHI KOGYO SEIYAKU CO., LTD.) and 73 parts of deionized water were heated to 90° C. and stirred for 10 minutes by a disperser. Then, this dispersion was heated to 100° C., and using a homogenizer (15-M-8PA model, manufactured by GAULIN), emulsifying was initiated under a pressure condition of about 15 MPa, and while measurement was carried out by a particle size distribution meter, dispersion was carried out to bring the volume average particle diameter to 200 nm to prepare a wax dispersion B.

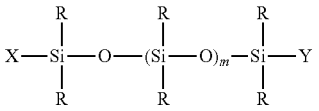

(1)

In the formula (1), R is a methyl group, m is 10, and X=Y=an alkyl group having an average carbon number of 30.

Preparation of Colorant Dispersion 20 parts of carbon black (Mitsubishi Carbon Black MA100S, manufactured by Mitsubishi Chemical Corporation), 1 part of an anionic surfactant (Neogen S20A, manufactured by DAI-ICHI KOGYO SEIYAKU CO., LTD.), 4 parts of a non-ionic surfactant (Emulgen 120, manufactured by Kao Corporation) and 75 parts of deionized water were dispersed by a sand grinder mill to obtain a black colorant dispersion. The volume average diameter of the particles measured by Microtrac UPA was 150 nm.

Preparation of Latex A1 of Primary Particles of Polymer

Into a reactor (volume: 60 liters, inner diameter: 400 mm) equipped with a stirring device (three vanes), a heating/cooling device, a concentrating device and devices for charging various raw materials and additives, 32.4 parts by weight of the wax dispersion A and 256 parts of deionized water were charged and heated to 90° C. in a nitrogen stream, whereupon 3.2 parts of a 8% hydrogen peroxide aqueous solution and 3.2 parts of a 8% ascorbic acid aqueous solution were added.

Then, a mixture of the following monomers and aqueous emulsifier solution was added over 5 hours from the initiation of the polymerization, and the aqueous initiator solution was added over 5 hours from the initiation of the polymerization. Further, from 5 hours after initiation of the polymerization, a 8% ascorbic acid aqueous solution was added over 2 hours as an additional aqueous initiator solution, and the system was maintained for further 1 hour. As the emulsifier, Neogen S20A was used which is a 20% sodium dodecylbenzene sulfonate (hereinafter referred to simply as DBS) aqueous solution manufactured by DAI-ICHI KOGYO SEIYAKU CO., LTD. (hereinafter referred to simply as a 20% DBS aqueous solution).

| MONOMERS | |
|---|---|
| Styrene | 76.8 parts |
| Butyl acrylate | 23.2 parts |
| Acrylic acid | 1.5 parts |
| Trichlorobromomethane | 1.0 part |
| Hexanediol diacrylate | 1.2 parts |

-continued

| AQUEOUS EMULSIFIER SOLUTION | |
|---|---|
| 20% DBS aqueous solution | 1.0 part |
| Deionized water | 67.5 parts |
| AQUEOUS INITIATOR SOLUTION | |
| 8% hydrogen peroxide aqueous solution | 15.5 parts |
| 8% ascorbic acid aqueous solution | 15.5 parts |
| ADDITIONAL AQUEOUS INITIATOR SOLUTION | |
| 8% ascorbic acid aqueous solution | 14.2 parts |

After completion of the polymerization reaction, the system was cooled to obtain a milky white polymer dispersion. The volume average particle diameter measured by UPA was 200 nm, the color shown by a POV test paper was pink, and the peroxide value was at most 10.

Preparation of Latex B1 of Primary Particles of Polymer

Into a reactor (volume: 60 liters, inner diameter: 400 mm) equipped with a stirring device (three vanes), a heating/cooling device, a concentrating device and devices for charging various raw materials and additives, 23.7 parts by weight of the wax dispersion B, 1.5 parts by weight of a 20% DBS aqueous solution and 326 parts of deionized water were charged and heated to 90° C. in a nitrogen stream, whereupon 3.2 parts of a 8% hydrogen peroxide aqueous solution and 3.2 parts of a 8% ascorbic acid aqueous solution were added.

Then, a mixture of the following monomers and aqueous emulsifier solution was added over 5 hours from the initiation of the polymerization, and the aqueous initiator solution was added over 5 hours from the initiation of the polymerization. Further, from 5 hours after the initiation of the polymerization, a 8% ascorbic acid aqueous solution was added over 2 hours as an additional aqueous initiator solution, and the system was maintained for further 1 hour.

| MONOMERS | |
|---|---|
| Styrene | 92.5 parts |
| Butyl acrylate | 7.5 parts |
| Acrylic acid | 1.5 parts |
| Trichlorobromomethane | 0.6 part |
| AQUEOUS EMULSIFIER SOLUTION | |
| 20% Neogen SC aqueous solution | 1.5 parts |
| Deionized water | 66.2 parts |
| AQUEOUS INITIATOR SOLUTION | |
| 8% hydrogen peroxide aqueous solution | 15.5 parts |
| 8% ascorbic acid aqueous solution | 15.5 parts |
| ADDITIONAL AQUEOUS INITIATOR SOLUTION | |
| 8% ascorbic acid aqueous solution | 14.2 parts |

After completion of the polymerization reaction, the system was cooled to obtain a milky white polymer dispersion. The volume average particle diameter measured by UPA was 260 nm, the color shown by a POV test paper was pink, and the peroxide value was at most 10.

| PREPARATION OF EMULSION POLYMERIZED AGGLOMERATED TONER 1 | |
|---|---|
| Latex A1 of primary particles of polymer | 95 parts (as solid content) |
| Latex B1 of primary particles of polymer | 5 parts (as solid content) |
| Dispersion of fine particles of colorant | 6 parts (as solid content) |
| 20% DBS aqueous solution | 0.1 part (as solid content) |

Using the above various components, a toner was prepared as follows.

Into a reactor (volume: 2 liters, double helical vanes with baffles), dispersion A1 of primary particles of polymer and 20% DBS aqueous solution were charged and uniformly mixed, and then, the dispersion of fine particles of colorant was added and uniformly mixed. While the obtained mixed dispersion was stirred, an aqueous solution containing 5% of ferrous sulfate was added in an amount of 0.52 part as $FeSO_4.7H_2O$. After mixing for 30 minutes, an aqueous aluminum sulfate solution was further added (0.29 part as solid content). Thereafter, with stirring, the temperature was raised to 52° C. over 45 minutes, and then, it was raised to 55° C. over 95 minutes. Here, particle size measurement was carried out by Coulter counter, whereby the 50% volume diameter was 6.8 μm. Then, primary particles B1 of polymer was added, and the system was maintained for 60 minutes, whereupon 20% DBS aqueous solution (8 parts as solid content) was added, and the temperature was raised to 92° C. over 30 minutes and maintained for 34 minutes. Then, cooling, filtration, washing with water and drying were carried out to obtain toner base particles.

To 100 parts of the obtained toner base particles, 0.5 part of fine particles of silica having an average primary particle diameter of 0.04 μm, subjected to hydrophobic treatment with silicone oil and 2.0 parts of fine particles of silica having an average primary particle diameter of 0.012 μm, subjected to hydrophobic treatment with silicone oil, were added, followed by stirring and mixing by a Henschel mixer to obtain an emulsion polymerized agglomerated toner 1.

Evaluation of Toner 1

The volume average particle diameter by Coulter counter of the emulsion polymerized agglomerated toner 1 was 6.8 μm; the number average particle diameter was 6.2 μm; and the average circularity was 0.96.

Further, this emulsion polymerized agglomerated toner was measured by gas chromatography by means of the above-described methods, whereby the contents of aliphatic aldehydes were 6.4 ng/ml (acetaldehyde), 0.010 ng/ml (1-propanal), 1.9 ng/ml (1-butanal), 0.60 ng/ml (1-pentanal), 1.2 ng/ml (1-hexanal), 0.10 ng/ml (1-heptanal), 0.84 ng/ml (1-octanal), 0.12 ng/ml (1-nonanal) and 0.071 ng/ml (1-decanal), and the contents of aliphatic acids were 0.51 ng/ml (acetic acid), 0.012 ng/ml (n-propionic acid), 0.0088 ng/ml (n-butyric acid), 0.016 ng/ml (n-pentanoic acid), 0.0024 ng/ml (n-hexanoic acid), 0.0013 ng/ml (n-heptanoic acid) and 0.0018 ng/ml (n-octanoic acid).

Further, the odor threshold values of the above aliphatic aldehydes were, respectively, 1.5 ppb (acetaldehyde), 1.0 ppb (1-propanal), 0.67 ppb (1-butanal), 0.41 ppb (1-pentanal), 0.28 ppb (1-hexanal), 0.18 ppb (1-heptanal), 0.010 ppb (1-octanal), 0.34 ppb (1-nonanal) and 0.40 ppb (1-decanal), and the odor indices of the above aliphatic acids were, respectively, 6.0 ppb (acetic acid), 5.7 ppb (n-propionic acid), 0.19 ppb (n-butyric acid), 0.037 ppb (n-pentanoic acid), 0.6 ppb (n-hexanoic acid), 0.21 ppb (n-heptanoic acid) and 5.0 ppb (n-octanoic acid).

Values obtained by dividing the contents of the aliphatic aldehydes contained in the emulsion polymerized agglomerated toner 1 by the respective odor threshold values, were summed up to obtain an odor index, whereby the odor index was 98, and the odor index of 1-octanal was 84. Further, in the same manner, the odor index of fatty acids was obtained and found to be 0.56.

The results of the odor panel test showed 50 points, and the judgment was ◎. Further, the judgment in the high temperature offset test was ○.

Example 2

Preparation of Latex A2 of Primary Particles of Polymer

Into a reactor (volume: 60 liters, inner diameter: 400 mm) equipped with a stirring device (three vanes), a heating/cooling device, a concentrating device and devices for charging various raw materials and additives, 32.2 parts by weight of the wax dispersion A and 262 parts of deionized water were charged and heated to 90° C. in a nitrogen stream, whereupon 3.2 parts of a 8% hydrogen peroxide aqueous solution and 3.2 parts of a 8% ascorbic acid aqueous solution were added.

Then, a mixture of the following monomers and aqueous emulsifier solution was added over 5 hours from the initiation of the polymerization, and the aqueous initiator solution was added over 5 hours from the initiation of the polymerization. Further, from 5 hours after the initiation of the polymerization, a 8% ascorbic acid aqueous solution was added over 2 hours as an additional aqueous initiator solution, and the system was maintained for further 1 hour.

| MONOMERS | |
|---|---|
| Styrene | 76.8 parts |
| Butyl acrylate | 23.2 parts |
| Acrylic acid | 1.5 parts |
| Trichlorobromomethane | 1.0 part |
| Hexanediol diacrylate | 1.2 parts |
| AQUEOUS EMULSIFIER SOLUTION | |
| 20% DBS aqueous solution | 1.0 part |
| Deionized water | 67.5 parts |
| AQUEOUS INITIATOR SOLUTION | |
| 8% hydrogen peroxide aqueous solution | 15.5 parts |
| 8% ascorbic acid aqueous solution | 15.5 parts |
| ADDITIONAL AQUEOUS INITIATOR SOLUTION | |
| 8% ascorbic acid aqueous solution | 4.92 parts |

After completion of the polymerization reaction, the system was cooled to obtain a milky white polymer dispersion. The volume average particle diameter measured by UPA was 202 nm; the color shown by a POV test paper was pale purple; and the peroxide value was higher than 10 and not higher than 30.

Preparation of Latex B2 of Primary Particles of Polymer

Into a reactor (volume: 60 liters, inner diameter: 400 mm) equipped with a stirring device (three vanes), a heating/cooling device, a concentrating device and devices for charging various raw materials and additives, 23.4 parts by weight of the wax dispersion B, 1.5 parts by weight of 20% DBS aqueous solution and 327 parts of deionized water were charged and heated to 90° C. in a nitrogen stream, whereupon 3.2 parts of a 8% hydrogen peroxide aqueous solution and 3.2 parts of a 8% ascorbic acid aqueous solution were added.

Then, a mixture of the following monomers and aqueous emulsifier solution was added over 5 hours from the initiation of the polymerization, and the aqueous initiator solution was added over 5 hours from the initiation of the polymerization. Further, from 5 hours after the initiation of the polymerization, a 8% ascorbic acid aqueous solution was added over 2 hours as an additional aqueous initiator solution, and the system was maintained for further 1 hour.

| MONOMERS | |
|---|---|
| Styrene | 92.5 parts |
| Butyl acrylate | 7.5 parts |

-continued

| | |
|---|---|
| Acrylic acid | 1.5 parts |
| Trichlorobromomethane | 0.6 part |
| AQUEOUS EMULSIFIER SOLUTION | |
| 20% Neogen SC aqueous solution | 1.5 parts |
| Deionized water | 66.2 parts |
| AQUEOUS INITIATOR SOLUTION | |
| 8% hydrogen peroxide aqueous solution | 15.5 parts |
| 8% ascorbic acid aqueous solution | 15.5 parts |
| ADDITIONAL AQUEOUS INITIATOR SOLUTION | |
| 8% ascorbic acid aqueous solution | 4.9 parts |

After completion of the polymerization reaction, the system was cooled to obtain a milky white polymer dispersion. The volume average particle diameter measured by UPA was 263 nm; the color shown by a POV test paper was pale purple; and the peroxide value was higher than 10 and not higher than 30.

Emulsion Polymerized Agglomerated Toner 2

An emulsion polymerized agglomerated toner 2 was obtained by using the same method and additives as in Example 1 except that instead of the latex A1 of primary particles of polymer, the latex A2 of primary particles of polymer was used, and instead of the latex B1 of primary particles of polymer, the latex B2 of primary particles of polymer was used.

Evaluation of Toner 2

The volume average particle diameter by Coulter counter of the emulsion polymerized agglomerated toner 2 was 6.9 μm; the number average particle diameter was 6.2 μm; and the average circularity was 0.96.

Further, this emulsion polymerized agglomerated toner was measured by gas chromatography by means of the above-described methods, whereby the contents of aliphatic aldehydes were 9.7 ng/ml (acetaldehyde), 0.07 ng/ml (1-propanal), 1.9 ng/ml (1-butanal), 0.9 ng/ml (1-pentanal), 3.3 ng/ml (1-hexanal), 0.26 ng/ml (1-heptanal), 2.3 ng/ml (1-octanal), 0.44 ng/ml (1-nonanal) and 0.16 ng/ml (1-decanal), and the contents of aliphatic acids were 0.51 ng/ml (acetic acid), 0.012 ng/ml (n-propionic acid), 0.019 ng/ml (n-butyric acid), 0.049 ng/ml (n-pentanoic acid), 0.0075 ng/ml (n-hexanoic acid), 0.0057 ng/ml (n-heptanoic acid) and 0.0083 ng/ml (n-octanoic acid).

This emulsion polymerized agglomerated toner was measured by gas chromatography by means of the above-mentioned method, whereby the odor index of aliphatic aldehydes was 258, and the odor index of 1-octanal was 231. Further, in the same manner, the odor index of aliphatic acids was obtained and found to be 1.5.

The results of the odor panel test showed 36 points, and the judgment was ○. Further, the judgment in the high temperature offset test was ○.

Comparative Example 1

Preparation of Latex A3 of Primary Particles of Polymer

Into a reactor (volume: 60 liters, inner diameter: 400 mm) equipped with a stirring device (three vanes), a heating/cooling device, a concentrating device and devices for charging various raw materials and additives, 32.5 parts by weight of the wax dispersion A and 253 parts of deionized water were charged and heated to 90° C. in a nitrogen stream, whereupon 3.2 parts of a 80 hydrogen peroxide aqueous solution and 3.2 parts of a 8% ascorbic acid aqueous solution were added.

Then, a mixture of the following monomers and aqueous emulsifier solution was added over 5 hours from the initiation of the polymerization, and the aqueous initiator solution was added over 5 hours from the initiation of the polymerization. Further, from 5 hours after the initiation of the polymerization, a 8% ascorbic acid aqueous solution and a 8% hydrogen peroxide aqueous solution were added over 2 hours as additional aqueous initiator solutions, and the system was maintained for further 1 hour.

| | |
|---|---|
| MONOMERS | |
| Styrene | 76.8 parts |
| Butyl acrylate | 23.2 parts |
| Acrylic acid | 1.5 parts |
| Trichlorobromomethane | 1.0 part |
| Hexanediol diacrylate | 1.2 parts |
| AQUEOUS EMULSIFIER SOLUTION | |
| 20% DBS aqueous solution | 1.0 part |
| Deionized water | 67.5 parts |
| AQUEOUS INITIATOR SOLUTION | |
| 8% hydrogen peroxide aqueous solution | 15.5 parts |
| 8% ascorbic acid aqueous solution | 15.5 parts |
| ADDITIONAL AQUEOUS INITIATOR SOLUTION | |
| 8% hydrogen peroxide aqueous solution | 9.3 parts |
| 8% ascorbic acid aqueous solution | 9.3 parts |

After completion of the polymerization reaction, the system was cooled to obtain a milky white polymer dispersion. The volume average particle diameter measured by UPA was 205 nm; the color shown by a POV test paper was dark blue; and the peroxide value was higher than 30.

Preparation of Latex B3 of Primary Particles of Polymer

Into a reactor (volume: 60 liters, inner diameter: 400 mm) equipped with a stirring device (three vanes), a heating/cooling device, a concentrating device and devices for charging various raw materials and additives, 23.9 parts by weight of the wax dispersion B, 1.5 parts by weight of 20% DBS aqueous solution and 325 parts of deionized water were charged and heated to 90° C. in a nitrogen stream, whereupon 3.2 parts of a 8% hydrogen peroxide aqueous solution and 3.2 parts of a 8% ascorbic acid aqueous solution were added.

Then, a mixture of the following monomers and aqueous emulsifier solution was added over 5 hours from the initiation of the polymerization, and the aqueous initiator solution was added over 5 hours from the initiation of the polymerization. Further, a 8% ascorbic acid aqueous solution and a 8% hydrogen peroxide aqueous solution were added over 2 hours as additional aqueous initiator solutions, and the system was maintained for further 1 hour.

| | |
|---|---|
| MONOMERS | |
| Styrene | 92.5 parts |
| Butyl acrylate | 7.5 parts |
| Acrylic acid | 1.5 parts |
| Trichlorobromomethane | 0.6 part |
| AQUEOUS EMULSIFIER SOLUTION | |
| 20% Neogen SC aqueous solution | 1.5 parts |
| Deionized water | 66.2 parts |
| AQUEOUS INITIATOR SOLUTION | |
| 8% hydrogen peroxide aqueous solution | 15.5 parts |
| 8% ascorbic acid aqueous solution | 15.5 parts |
| ADDITIONAL AQUEOUS INITIATOR SOLUTION | |
| 8% hydrogen peroxide aqueous solution | 9.3 parts |
| 8% ascorbic acid aqueous solution | 9.3 parts |

After completion of the polymerization reaction, the system was cooled to obtain a milky white polymer dispersion. The volume average particle diameter measured by UPA was 268 nm; the color shown by a POV test paper was dark blue; and the peroxide value was higher than 30.

Preparation of Emulsion Polymerized Agglomerated Toner 3

An emulsion polymerized agglomerated toner 3 was obtained by using the same method and additives as used in Example 1 except that instead of the latex A1 of primary particles of polymer, the latex A3 of primary particles of polymer was used, and instead of the latex B1 of primary particles of polymer, the latex B3 of primary particles of polymer was used.

Evaluation of Toner 3

The volume average particle diameter by Coulter counter of the emulsion polymerized agglomerated toner 3 was 6.9 μm; the number average particle diameter was 6.2 μm; and the average circularity was 0.96.

Further, this emulsion polymerized agglomerated toner was measured by gas chromatography by means of the above-described methods, whereby the contents of aliphatic aldehydes were 8.7 ng/ml (acetaldehyde), 0.051 ng/ml (1-propanal), 1.5 ng/ml (1-butanal), 1.1 ng/ml (1-pentanal), 3.8 ng/ml (1-hexanal), 0.33 ng/ml (1-heptanal), 3.9 ng/ml (1-octanal), 0.67 ng/ml (1-nonanal) and 0.24 ng/ml (1-decanal), and the contents of aliphatic acids were 0.68 ng/ml (acetic acid), 0.013 ng/ml (n-propionic acid), 0.023 ng/ml (n-butyric acid), 0.070 ng/ml (n-pentanoic acid), 0.011 ng/ml (n-hexanoic acid), 0.010 ng/ml (n-heptanoic acid) and 0.0080 ng/ml (n-octanoic acid).

This emulsion polymerized agglomerated toner was measured by gas chromatography by means of the above-mentioned method, whereby the odor index of aliphatic aldehydes was 415, and the odor index of 1-octanal was 387. Further, in the same manner, the odor index of aliphatic acids was obtained and found to be 2.2.

The results of the odor panel test showed 19 points, and the judgment was X. Further, the judgment in the high temperature offset test was ○.

The evaluation results in Examples 1 and 2 and Comparative Example 1 are shown in Table 1.

INDUSTRIAL APPLICABILITY

The present invention provides a method for producing an emulsion polymerized agglomerated toner for electrostatic charge image, which is excellent in the fixing property even at a high temperature without deteriorating other properties and which does not emit an odor offensive to people, and it becomes possible to supply such a toner to copying machines and printers of an electrophotographic system.

The entire disclosure of Japanese Patent Application No. 2004-316450 filed on Oct. 29, 2004 including specification, claims and summary is incorporated herein by reference in its entirety.

The invention claimed is:

1. A method for making an emulsion polymerized agglomerated toner comprising a crosslinked styrene resin binder, the method comprising (1) polymerization, which is carried out by seed polymerization in the presence of a dispersion of a wax in the form of particles having an average diameter of from 0.01 μm to 3 μm and a redox initiator, wherein the wax is at least one member selected from the group consisting of an olefin wax, an ester wax having a long chain alkyl group, a ketone having a long chain alkyl group, and a long chain aliphatic alcohol, thereby forming a latex of primary particles comprising said crosslinked styrene resin and said wax, (2) mixing said latex of primary particles and a dispersion of colorant particles, thereby forming an emulsion polymerized latex having a peroxide value of at most 30, (3) flocculating primary particles of the emulsion polymerized latex thereby forming agglomerates of primary particles, (4) fusing the primary particles of the agglomerates to one another, and (5) washing and drying the fused agglomerates, thereby forming said toner, the toner having a volume average particle diameter of from 3 to 8 μm, and wherein an odor index as calculated from the contents of aliphatic aldehydes in the toner measured by gas chromatography and the odor threshold values of the aliphatic aldehydes, is at most 300.

TABLE 1

| Latex of primary particles of polymer | | Peroxide value of latex: Color of test paper for peroxide value | Peroxide value of latex: Peroxide value (K) | n-Hexanal + n-heptanal + n-octanal (ng/ml · Headspace in vial) | n-Octanal (ng/ml · Headspace in vial) | Odor index: Aliphatic aldehydes | Odor index: 1-Octanal | Odor index: Aliphatic acids | Odor panel test: Points | Odor panel test: Judgment | High temperature offset test judgment |
|---|---|---|---|---|---|---|---|---|---|---|---|
| Example 1 | A1 | Pink | K ≤ 10 | 2.1 | 0.84 | 98 | 84 | 0.56 | 50 | ◎ | ○ |
| | B1 | Pink | K ≤ 10 | | | | | | | | |
| Example 2 | A2 | Pale purple | 10 < K ≤ 30 | 5.9 | 2.3 | 258 | 231 | 1.5 | 36 | ○ | ○ |
| | B2 | Pale purple | 10 < K ≤ 30 | | | | | | | | |
| Comp. Ex. 1 | A3 | Dark blue | 30 < K | 8.0 | 3.9 | 415 | 387 | 2.2 | 19 | X | ○ |
| | B3 | Dark blue | 30 < K | | | | | | | | |

2. The method according to claim 1, wherein the odor index of 1-octanal among the aliphatic aldehydes is at most 280.

3. The method according to claim 1, wherein the odor index is at most 200.

4. The method according to claim 1, wherein the odor index is at most 100.

5. The method according to claim 2, wherein the odor index of 1-octanal is at most 240.

6. The method according to claim 2, wherein the odor index of 1-octanal is at most 90.

7. The method according to claim 1, wherein an odor index of aliphatic acids is at most 2.

8. The method according to claim 1, wherein an odor index of aliphatic acids is at most 1.5.

9. The method according to claim 1, wherein an odor index of aliphatic acids is at most 1.0.

10. The method according to claim 1, wherein the peroxide value is at most 10.

11. The method according to claim 1, wherein the redox initiator comprises hydrogen peroxide and ascorbic acid.

* * * * *